US011215030B2

(12) United States Patent
Palmer et al.

(10) Patent No.: US 11,215,030 B2
(45) Date of Patent: Jan. 4, 2022

(54) LOCKING BACKPRESSURE VALVE WITH SHIFTABLE VALVE SEAT

(71) Applicants: Larry Thomas Palmer, Spring, TX (US); Erik Van Steveninck, Houston, TX (US); Steve Wilson, III, Magnolia, TX (US)

(72) Inventors: Larry Thomas Palmer, Spring, TX (US); Erik Van Steveninck, Houston, TX (US); Steve Wilson, III, Magnolia, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/889,865

(22) Filed: Jun. 2, 2020

(65) Prior Publication Data

US 2021/0372230 A1 Dec. 2, 2021

(51) Int. Cl.
*E21B 34/14* (2006.01)

(52) U.S. Cl.
CPC ..... *E21B 34/14* (2013.01); *E21B 2200/05* (2020.05)

(58) Field of Classification Search
CPC ..... E21B 34/14; E21B 2200/05; E21B 34/12
See application file for complete search history.

(56) References Cited

U.S. PATENT DOCUMENTS 3,289,693 A 12/1966 Scaramucci
3,376,935 A 4/1968 Baker
3,951,338 A 4/1976 Genna
3,958,633 A 5/1976 Britch et al.
4,033,429 A 7/1977 Farr
4,100,969 A 7/1978 Randermann, Jr.
4,220,206 A 9/1980 Van Winkle
4,393,930 A 7/1983 Ross et al.
4,407,329 A 10/1983 Huebsch et al.
(Continued)

FOREIGN PATENT DOCUMENTS

CN 103410491 A 11/2013
CN 110173233 A 8/2019
(Continued)

OTHER PUBLICATIONS

International Search Report and Written Opinion for International Application No. PCT/US2019/026878; International Filing Date Apr. 11, 2019; dated Jul. 26, 2019 (pp. 1-8).
(Continued)

*Primary Examiner* — Michael R Wills, III
(74) *Attorney, Agent, or Firm* — Cantor Colburn LLP

(57) ABSTRACT

A downhole tool includes a tubular having an outer surface and an inner surface defining a flowbore having a longitudinal axis, and a backpressure valve cartridge arranged in the flowbore. The backpressure valve cartridge includes a passage, a valve seat arranged in the passage, and a flapper valve pivotally mounted relative to the valve seat in the passage. The valve seat is shiftable within the backpressure valve cartridge along the longitudinal axis to shift the flapper valve between a first position, wherein the flapper valve is free to pivot relative to the valve seat, and a second position, wherein the flapper valve is pivoted away from the valve seat and maintained in an open configuration.

18 Claims, 7 Drawing Sheets

(56) References Cited

U.S. PATENT DOCUMENTS

| | | | | |
|---|---|---|---|---|
| 4,474,241 | A | 10/1984 | Freeman | |
| 4,566,541 | A | 1/1986 | Moussy et al. | |
| 4,597,449 | A | 7/1986 | Keeney | |
| 4,676,307 | A | 6/1987 | Pringle | |
| 4,729,432 | A | 3/1988 | Helms | |
| 4,782,895 | A | 11/1988 | Jacob et al. | |
| 5,022,427 | A | 6/1991 | Churchman et al. | |
| 5,159,981 | A | 11/1992 | Le | |
| 5,496,044 | A | 3/1996 | Beall et al. | |
| 6,260,850 | B1 | 7/2001 | Beall et al. | |
| 6,446,665 | B2 | 9/2002 | Coscarella | |
| 6,547,007 | B2 | 4/2003 | Szarka et al. | |
| 6,568,470 | B2 | 5/2003 | Goodson, Jr. et al. | |
| 6,957,703 | B2 | 10/2005 | Trott et al. | |
| 7,063,156 | B2 | 6/2006 | Patel et al. | |
| 7,299,880 | B2 | 11/2007 | Logiudice et al. | |
| 7,360,600 | B2 | 4/2008 | MacDougall et al. | |
| 7,665,528 | B2 | 2/2010 | Ross et al. | |
| 8,607,811 | B2 | 12/2013 | Korkmaz | |
| 8,893,796 | B2 | 11/2014 | Conner et al. | |
| 8,955,543 | B2 * | 2/2015 | Groesbeck | E21B 34/16 137/513 |
| 9,163,479 | B2 | 10/2015 | Rogers et al. | |
| 10,619,448 | B1 | 4/2020 | Watson et al. | |
| 2001/0023706 | A1 | 9/2001 | Coscarella | |
| 2003/0121665 | A1 | 7/2003 | Trott | |
| 2004/0060704 | A1 | 4/2004 | Layton et al. | |
| 2007/0137869 | A1 | 6/2007 | MacDougall et al. | |
| 2010/0139923 | A1 | 6/2010 | Biddick | |
| 2010/0212907 | A1 | 8/2010 | Frazier | |
| 2011/0088908 | A1 * | 4/2011 | Xu | E21B 34/10 166/332.8 |
| 2011/0174505 | A1 | 7/2011 | Gill et al. | |
| 2011/0290344 | A1 | 12/2011 | Groesbeck et al. | |
| 2012/0305257 | A1 * | 12/2012 | Conner | E21B 21/10 166/323 |
| 2012/0321446 | A1 | 12/2012 | Blewett et al. | |
| 2015/0136404 | A1 | 5/2015 | Groesbeck et al. | |
| 2015/0211333 | A1 | 7/2015 | Vick, Jr. et al. | |
| 2016/0138365 | A1 | 5/2016 | Vick, Jr. et al. | |
| 2016/0138368 | A1 * | 5/2016 | Girola | E21B 21/106 166/332.8 |
| 2016/0230503 | A1 | 8/2016 | Holmberg et al. | |
| 2016/0281465 | A1 | 9/2016 | Grayson et al. | |
| 2016/0341002 | A1 * | 11/2016 | McKitrick, III | E21B 34/14 |
| 2017/0175488 | A1 * | 6/2017 | Lisowski | E21B 43/267 |
| 2017/0370186 | A1 | 12/2017 | Stair | |
| 2018/0058177 | A1 | 3/2018 | Bigrigg et al. | |
| 2018/0209246 | A1 | 7/2018 | Miller et al. | |
| 2018/0334833 | A1 | 11/2018 | Brewer | |
| 2018/0334883 | A1 | 11/2018 | Williamson | |
| 2018/0347301 | A1 * | 12/2018 | Hilliard | E21B 34/10 |
| 2019/0003286 | A1 | 1/2019 | Bigrigg et al. | |
| 2019/0331235 | A1 | 10/2019 | Prather et al. | |
| 2019/0338620 | A1 | 11/2019 | Burris et al. | |
| 2020/0190941 | A1 | 6/2020 | Watson et al. | |

FOREIGN PATENT DOCUMENTS

| | | | |
|---|---|---|---|
| EP | 2535504 | A1 | 12/2012 |
| EP | 3561220 | A1 | 10/2019 |
| WO | 2004031534 | A1 | 4/2004 |
| WO | 2006024811 | A1 | 3/2006 |
| WO | 2007073401 | A1 | 6/2007 |
| WO | 2007125335 | A1 | 11/2007 |
| WO | 2017052556 | A1 | 3/2017 |

OTHER PUBLICATIONS

International Search Report and Written Opinion for International Application No. PCT/US2021/034166; International Filing Date May 26, 2021; dated Aug. 27, 2021 (pp. 1-11)

International Search Report and Written Opinion for International Application No. PCT/US2021/034167; International Filing Date May 26, 2021; dated Sep. 14, 2021 (pp. 1-10).

International Search Report and Written Opinion for International Application No. PCT/US2021/034168; International Filing Date May 26, 2021; dated Sep. 3, 2021 (pp. 1-11).

International Search Report and Written Opinion for International Application No. PCT/US2021/034170; International Filing Date May 26, 2021; dated Aug. 27, 2021 (pp. 1-11).

International Search Report and Written Opinion for International Application No. PCT/US2021/034173; International Filing Date May 26, 2021; dated Sep. 16, 2021 (pp. 1-10).

International Search Report and Written Opinion for International Application No. PCT/US2021/034174; International Filing Date May 26, 2021; dated Aug. 30, 2021 (pp. 1-10).

International Search Report and Written Opinion for International Application No. PCT/US2021/034175; International Filing Date May 26, 2021; dated Sep. 16, 2021 (pp. 1-11).

* cited by examiner

LOCKING BACKPRESSURE VALVE WITH SHIFTABLE VALVE SEAT

BACKGROUND

In the drilling and completion industry boreholes are formed to provide access to a resource bearing formation. Occasionally, it is desirable to install a plug in the borehole in order to isolate a portion of the resource bearing formation. When it is desired to access the portion of the resource bearing formation to begin production, a drill string is installed with a bottom hole assembly including a bit or mill. The bit or mill is operated to cut through the plug. After cutting through the plug, the drill string is removed, and a production string is run downhole to begin production. Withdrawing and running-in strings including drill strings and production strings is a time consuming and costly process. The industry would be open to systems that would reduce costs and time associated with plug removal and resource production.

SUMMARY

Disclosed is a downhole tool including a tubular having an outer surface and an inner surface defining a flowbore having a longitudinal axis, and a backpressure valve cartridge arranged in the flowbore. The backpressure valve cartridge includes a passage, a valve seat arranged in the passage, and a flapper valve pivotally mounted relative to the valve seat in the passage. The valve seat is shiftable within the backpressure valve cartridge along the longitudinal axis to shift the flapper valve between a first position, wherein the flapper valve is free to pivot relative to the valve seat, and a second position, wherein the flapper valve is pivoted away from the valve seat and maintained in an open configuration.

Also disclosed is a resource exploration and recovery system including a first system and a second system fluidically connected to the first system. The second system includes at least one tubular extending into a formation. The at least one tubular supports a downhole tool and includes an outer surface and an inner surface defining a flowbore having a longitudinal axis. The downhole tool includes a backpressure valve cartridge arranged in the flowbore. The backpressure valve cartridge includes a passage, a valve seat arranged in the passage, and a flapper valve pivotally mounted relative to the valve seat in the passage. The valve seat is shiftable within the backpressure valve cartridge along the longitudinal axis to shift the flapper valve between a first position, wherein the flapper valve is free to pivot relative to the valve seat, and a second position, wherein the flapper valve is pivoted away from the valve seat and maintained in an open configuration.

Still further disclosed is a method of operating a backpressure valve including shifting a valve seat arranged in a passage of a backpressure valve cartridge including a flapper valve along a longitudinal axis of a flowbore, and engaging the flapper valve with the valve seat causing the flapper valve to pivot about a hinge and transition from a first position, wherein the flapper valve is free to rotate about the hinge to a second position, wherein the flapper valve is pivoted away from the valve seat and maintained in an open configuration.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
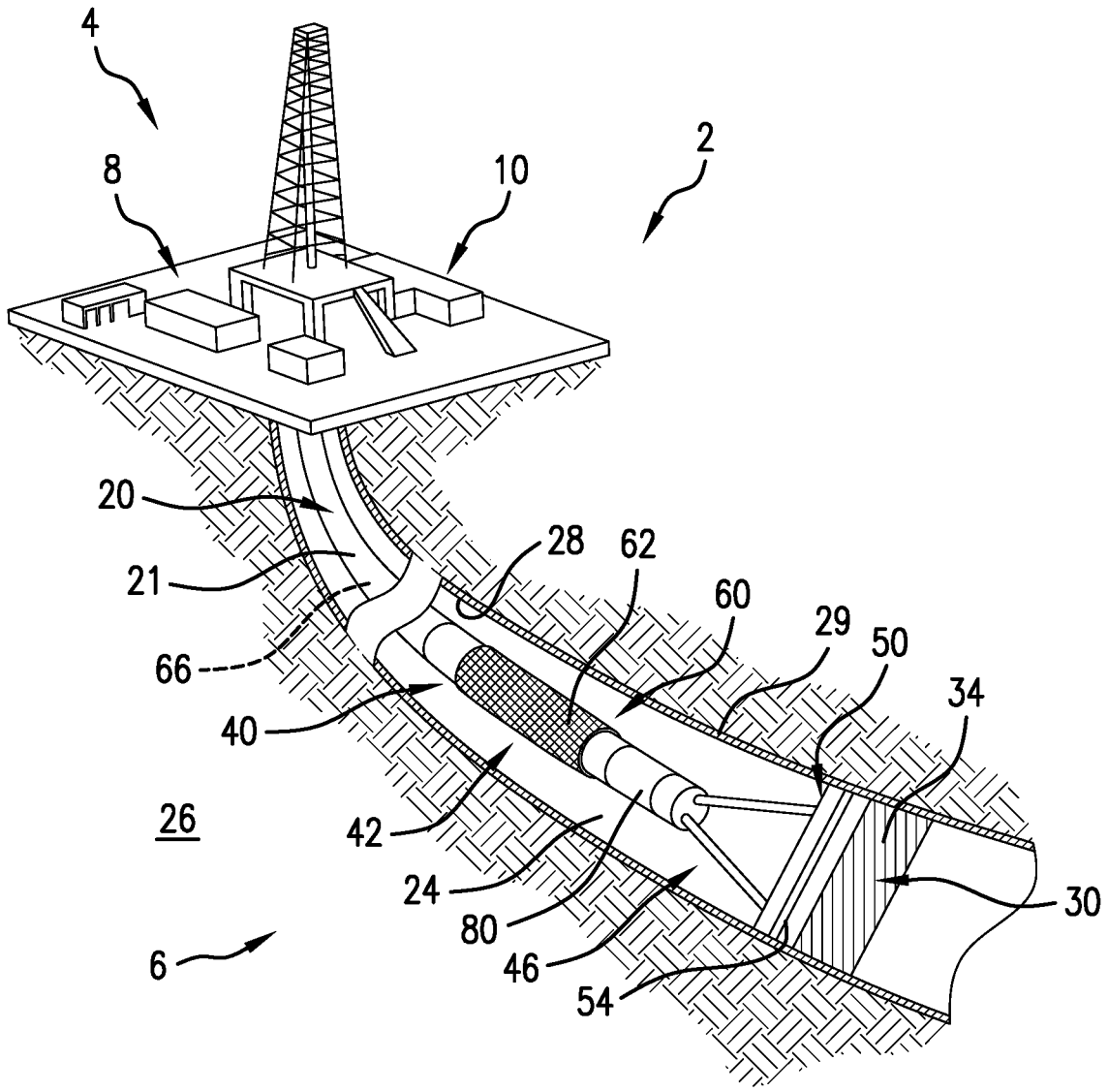
FIG. 1 depicts a resource exploration and recovery system including a locking backpressure valve, in accordance with an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery, $CO_2$ sequestration, and the like. Resource exploration and recovery system 2 may include a first system 4 which takes the form of a surface system operatively connected to a second system 6 which takes the form of a subsurface or subterranean system. First system 4 may include pumps 8 that aid in completion and/or extraction processes as well as fluid storage 10. Fluid storage 10 may contain a gravel pack fluid or slurry, or drilling mud (not shown) or other fluid which may be introduced into second system 6.

Second system 6 may include a downhole string 20 formed from one or more tubulars such as indicated at 21 that is extended into a wellbore 24 formed in formation 26. Wellbore 24 includes an annular wall 28 that may be defined by a wellbore casing 29 provided in wellbore 24. Of course, it is to be understood, that annular wall 28 may also be defined by formation 26. In the exemplary embodiment shown, subsurface system 6 may include a downhole zonal isolation device 30 that may form a physical barrier between one portion of wellbore 24 and another portion of wellbore 24. Downhole zonal isolation device 30 may take the form of a bridge plug 34. Of course, it is to be understood that zonal isolation device 30 may take on various forms including frac plugs formed from composite materials and/or metal, sliding sleeves and the like.

In further accordance with an exemplary embodiment, downhole string 20 defines a drill string 40 including a plug removal and production system 42. Plug removal and production system 42 is arranged at a terminal end portion (not separately labeled) of drill string 40. Plug removal and production system 42 includes a bottom hole assembly (BHA) 46 having a plug removal member 50 which may take the form of a bit or a mill 54. Of course, it is to be understood that plug removal member 50 may take on various forms such as a mill or a bit. BHA 46 may take on a variety of forms known in the art.

Plug removal and production system 42 includes a selective sand screen 60 arranged uphole of BHA 46. Selective sand screen 60 includes a screen element 62 that is arranged over a plurality of openings (not shown) formed in drill string 40. It is to be understood that the number of screen elements may vary. Further, it is to be understood that screen opening size may vary. It is also to be understood that screen element 62 may include a number of screen layers. The openings in drill string 40 fluidically connect wellbore 24 with a flow path 66 extending through drill string 40.

Figure 2:
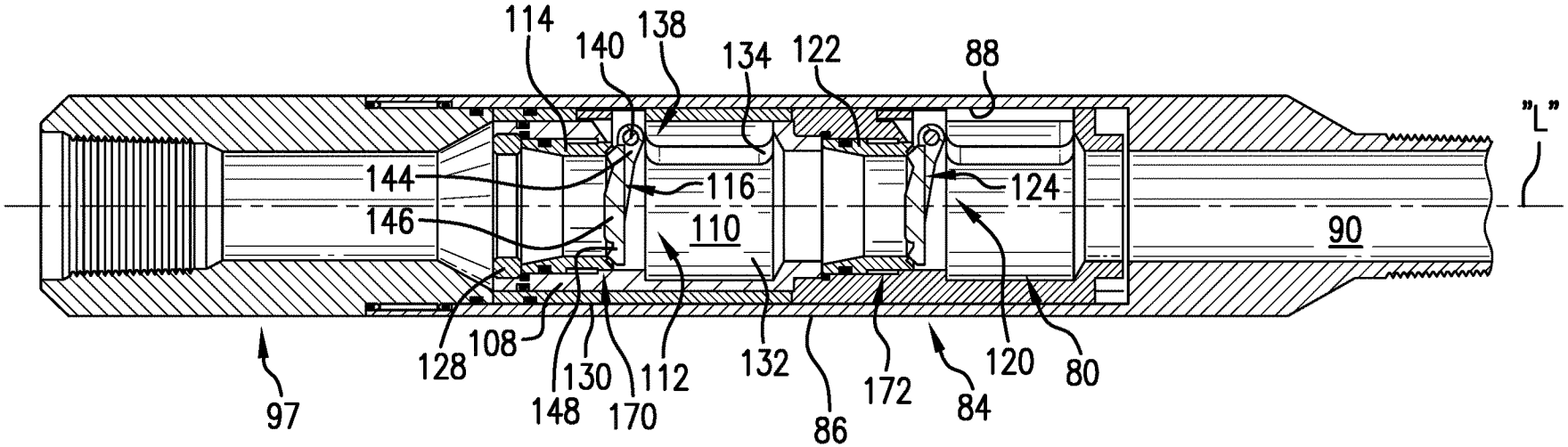
FIG. 2 depicts a cross-sectional side view of the locking backpressure valve in a run-in configuration, in accordance with an exemplary aspect.

In yet still further accordance with an exemplary embodiment, plug removal and production system 42 includes a backpressure valve (BPV) 80 arranged downhole of selective sand screen 60 and uphole of BHA 46. Referring to FIG. 2, BPV 80 includes a tubular 84 that forms part of drill string 40. Tubular 84 includes an outer surface 86 and an inner surface 88 that defines a flowbore 90 having a longitudinal axis "L" that receives BPV 80. Tubular 84 is shown to include a connector 97 that may be removed to provide access to flowbore 90.

In accordance with an exemplary aspect, BPV 80 includes a backpressure valve cartridge (BPC) 108 having a passage 110. A first valve portion 112 including a first valve seat 114 and a first flapper valve 116, and a second valve portion 120 having a second valve seat 122 and a second flapper valve 124 is arranged along passage 110. First valve portion 112 may be connected to second valve portion 120 through a plurality of threads (not separately labeled). A lock ring 128 may be employed to secure valve seat 114 against first valve portion 112. Reference will now follow to first valve portion 112 with an understanding that second valve portion 120 includes similar structure.

First valve portion 112 includes an outer surface section 130 and an inner surface section 132, and an opening 134. Opening 134 is selectively receptive of first flapper valve 116. First valve portion 112 includes a hinge 138 that receives a hinge pin 140 that pivotally supports first flapper valve 116. In further accordance with an exemplary aspect, first flapper valve 116 includes a hinge portion 144 and a valve portion 146 having a sealing surface 148.

Figure 3:
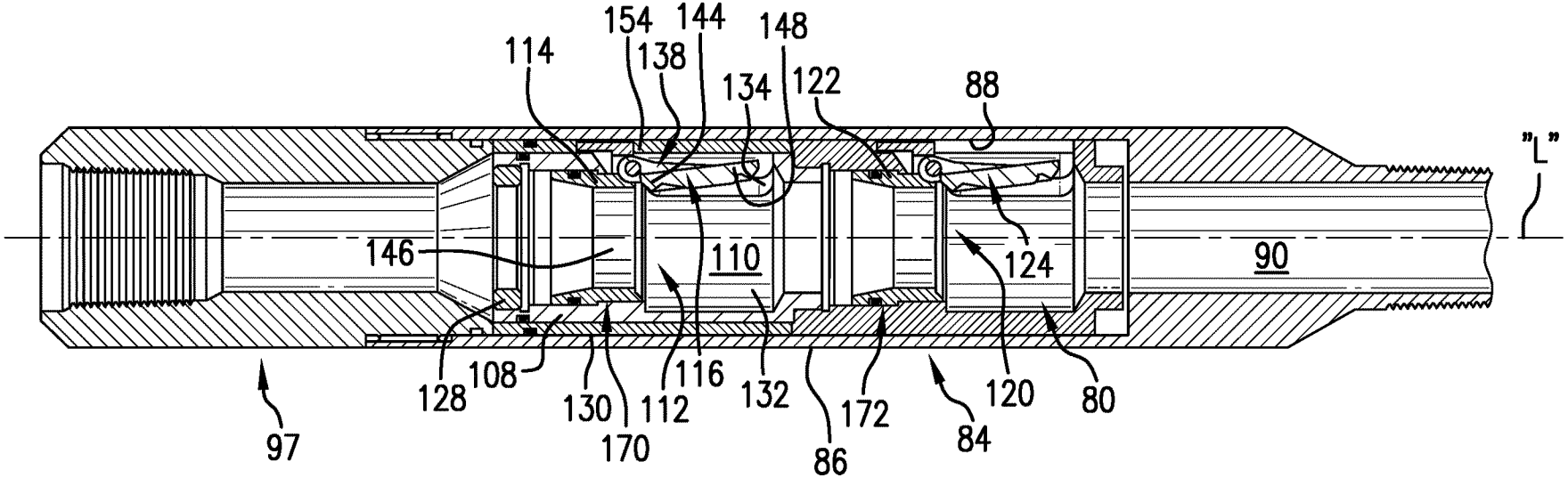
FIG. 3 depicts a cross-sectional side view of the locking backpressure valve in a production configuration, in accordance with an exemplary aspect.

As will be detailed herein, first valve seat 114 may be shifted along the longitudinal axis "L" within passage 110 to shift first flapper valve 116 between a first or closed position as shown in FIG. 2 and a second position or open position as shown in FIG. 3. Similarly, second valve seat 122 may be shifted along the longitudinal axis "L" within passage 110 to shift second flapper valve 124 between the first or closed position as shown in FIG. 2 and the second position or open position as shown in FIG. 3.

In an embodiment, after mill 54 opens a downhole most plug (not shown), BHA 46 may be pumped off and allowed to fall and collect at a toe (not shown) of wellbore 24. During drilling, BPC 108 is arranged in the first position (FIG. 2) whereby first flapper valve 16 and second flapper valve 124 are free to pivot in first valve portion 112 and second valve portion 120 respectively. In this manner, drilling fluids may pass downhole toward BHA 46, but pressure may not pass uphole beyond BPV 80. That is, pressure moving in an uphole direction would act against and cause first flapper valve 116 and second flapper valve 124 to close.

After pumping off BHA 46, it may be desirable to produce fluids through drill string 40. As such, BPV 80 is moved to the second position (FIG. 3) opening flowbore 90. A first object, such as a first drop ball 160 may be introduced into drill string 40 and allowed to fall onto second valve seat 120. Pressure is applied to first drop ball 160 causing second valve seat 120 to shift along the longitudinal axis "L" within passage 110 and contact second flapper valve 124. First drop ball 160 may be allowed to dissolve opening flowbore 90. Alternatively, additional pressure may be applied causing first drop ball 160 to pass through second valve seat 122 to open flowbore 90.

At this point, a second object, such as a second drop ball 164, which is larger than first drop ball 160, may be introduced into drill string 40 and allowed to fall onto first valve seat 114. Pressure is applied to second drop ball 164 causing first valve seat 114 to shift along the longitudinal axis "L" within passage 110 and contact first flapper valve 116. Second drop ball 164 may be allowed to dissolve opening flowbore 90. Alternatively, additional pressure may be applied causing second drop ball 164 to pass through second valve seat 122 to open flowbore 90. At this point it should be understood that while described as being a drop ball, the object may take on various forms such as balls, darts, plugs and the like.

In an embodiment, BPC 108 includes a first locking mechanism 170 associated with first valve portion 112, and a second locking mechanism 172 associated with second valve portion 120. As each locking mechanism 170, 172 is substantially the identically formed, a detailed description will follow with reference to first locking mechanism 170 with an understanding that second locking mechanism 172 includes similar structure.

In an embodiment, first locking mechanism 170 includes a taper (not separately labeled) formed in passage 110. When pressure is applied to second drop ball 164, first valve seat 114 is shifted and locked in place in passage 110 due to an interference fit caused by the taper. At this point, it should be understood, that while the taper is described as being on the passage 110, the taper may be provided on the valve seat, and/or the passage and the valve seat.

Figure 4:
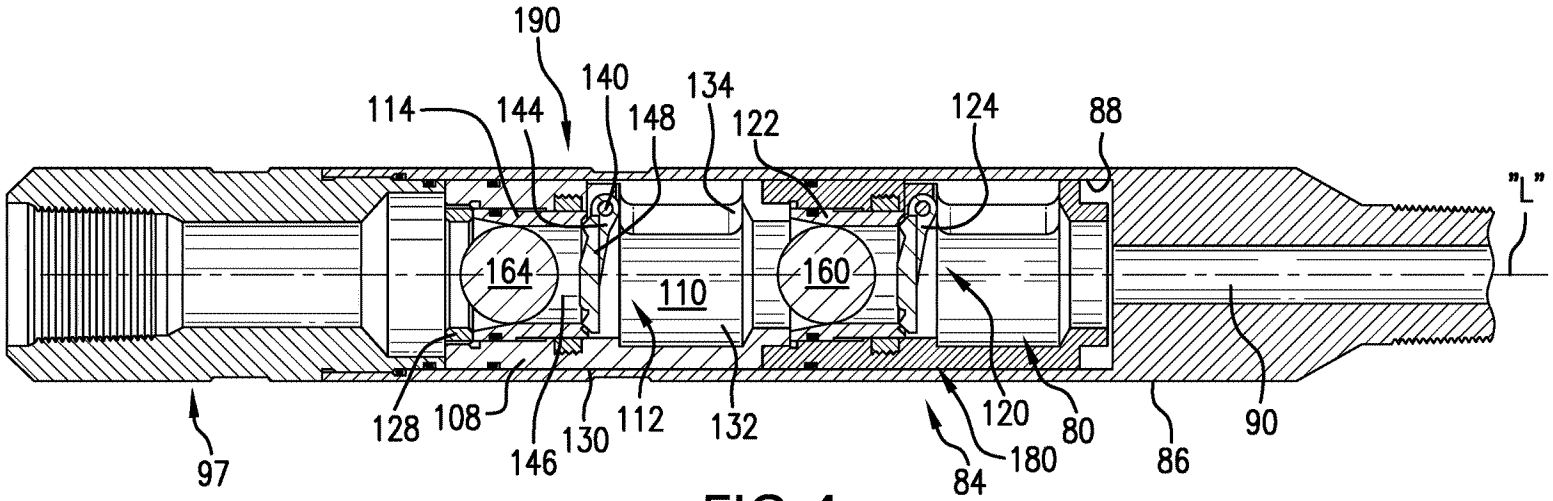
FIG. 4 depicts a cross-sectional side view of a locking backpressure valve in a run-in configuration, in accordance with another exemplary embodiment.
Figure 5:
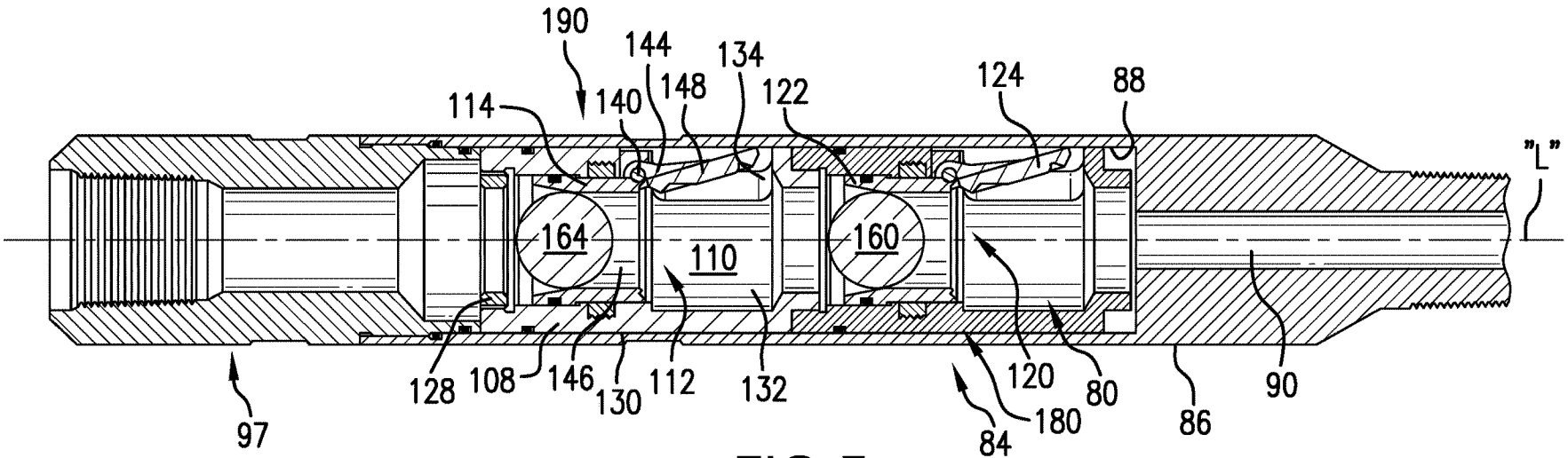
FIG. 5, depicts a cross-sectional side view of the locking backpressure valve of FIG. 4 in a production configuration, in accordance with another exemplary aspect.

Reference will now follow to FIGS. 4 and 5, wherein like reference numbers represent corresponding parts in the respective views in describing a locking mechanism 180 in accordance with another aspect of an exemplary embodiment. Locking mechanism 180 may include first and second body lock rings 184 and 186 arranged along passage 110. First and second valve seats 114 and 122 include structure, such as tooth elements (not separately labeled) that engage with corresponding structure on each body lock ring 184 and 186. The tooth elements may be angled to allow axial moving in one direction while resisting axial movement in an opposite direction. Thus, after utilizing drop balls 160 and 164 to shift first and second valve seats 114 and 122 from the first position (FIG. 4) to the second position (FIG. 5), locking mechanism 180 maintains first and second flapper valves 116 and 124 in the open configuration.

Figure 6:
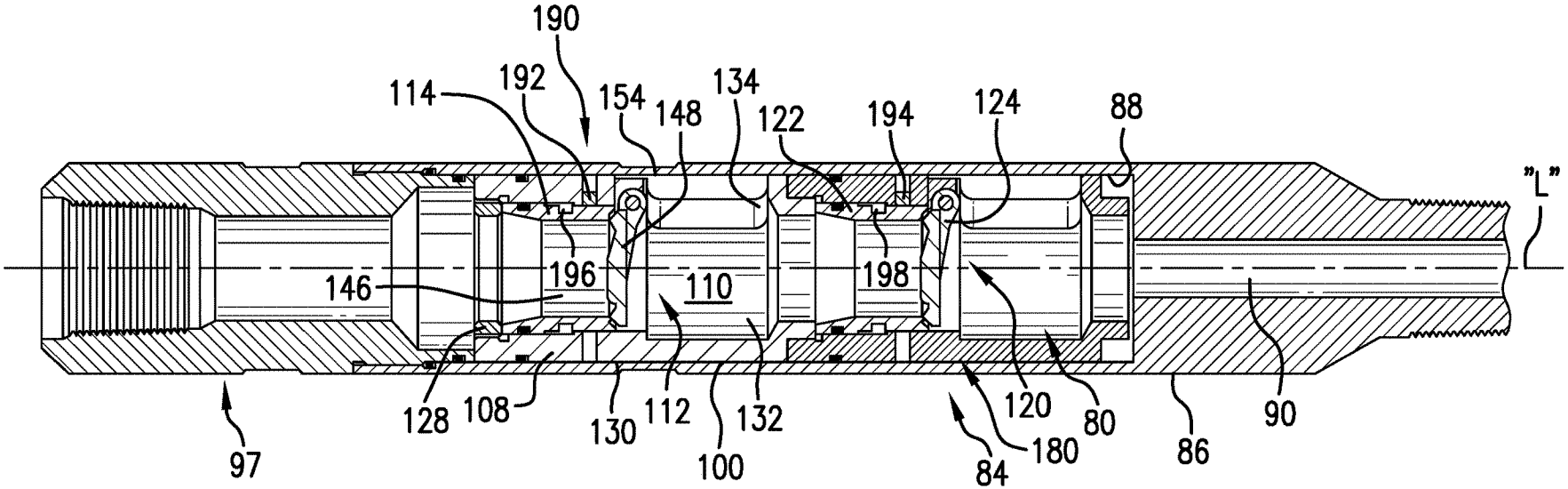
FIG. 6 depicts a cross-sectional side view of a locking backpressure valve, in accordance with yet another exemplary embodiment.
Figure 7:
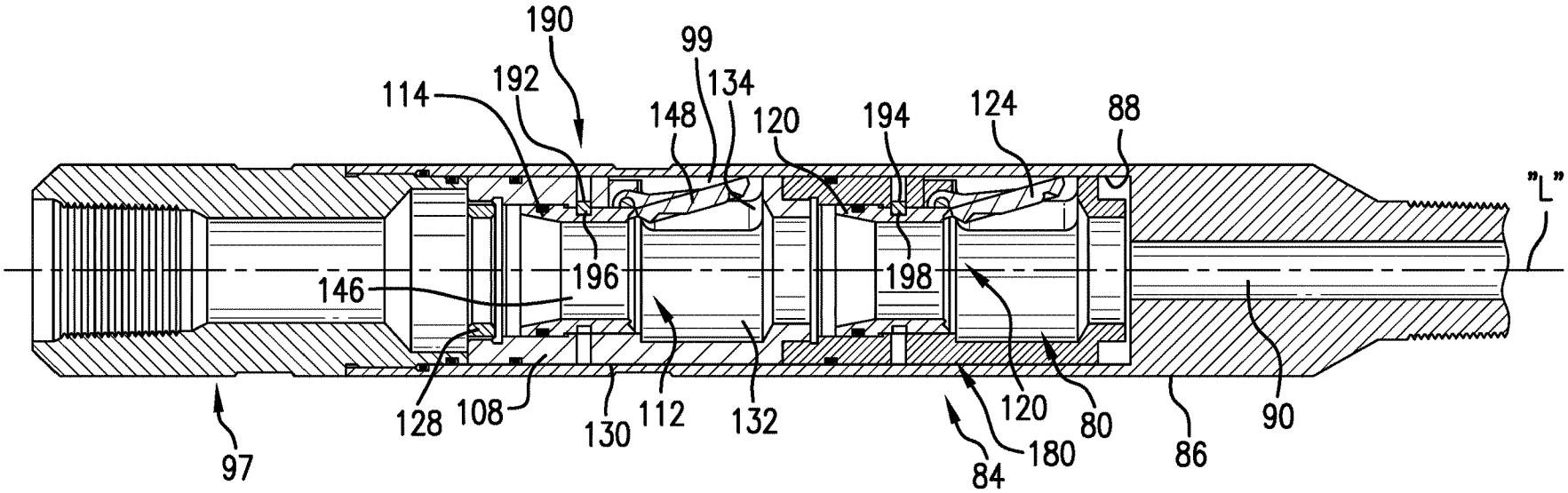
FIG. 7 depicts a cross-sectional side view of the locking backpressure valve of FIG. 6 in a run-in configuration.

Reference will now follow to FIGS. 6 and 7, wherein like reference numbers represent corresponding parts in the respective views, in describing a locking mechanism 190 in accordance with an exemplary aspect. Locking mechanism 190 includes a first radially inwardly biased dog 192 arranged radially outwardly of first valve seat 114 and a second radially inwardly biased dog 194 arranged radially outwardly of second valve seat 122. First valve seat 114 includes a recess 196 the is selectively receptive of first dog 192 and second valve seat 122 includes a recess portion 198 that is selectively receptive of second dog 194.

In a run-in configuration, such as shown in FIG. 6, first and second flapper valves 116 and 124 are free to pivot between open and closed configurations. During production, first and second valve seats 114 and 122 are shifted along longitudinal axis "L" and locked into place by locking mechanism 190 such that first and second flapper valves 116 and 124 are secured in the open position for production as shown in FIG. 7. After shifting, a first spring 202 biases first dog 192 into recess 196 and a second spring 204 biases second dog 194 into recess portion 198. Once engaged, first and second dogs 192 and 194 prevent first and second valve seats 114 and 122 from shifting back along the longitudinal axis "L".

At this point it should be understood that the exemplary embodiments describe a system for actuating a backpressure valve by shifting a valve seat within a self-contained backpressure valve cartridge. The backpressure valve cartridge includes a valve portion having the valve seat and a flapper valve. The flapper valve may be shifted from one position to another position simply by moving the valve seat. A locking mechanism may be employed to lock the flapper valve in position after shifting. It should be understood that while shown as including two valve portions, backpressure valve cartridge may include any number of valves. Further, while shown as being shifted to open valves, it should be understood that the cartridge could also be shifted to close valves.

Set forth below are some embodiments of the foregoing disclosure:

Embodiment 1. A downhole tool comprising: a tubular having an outer surface and an inner surface defining a flowbore having a longitudinal axis; and a backpressure valve cartridge arranged in the flowbore, the backpressure valve cartridge including a passage, a valve seat arranged in the passage, and a flapper valve pivotally mounted relative to the valve seat in the passage, wherein the valve seat is shiftable within the backpressure valve cartridge along the longitudinal axis to shift the flapper valve between a first position, wherein the flapper valve is free to pivot relative to the valve seat, and a second position, wherein the flapper valve is pivoted away from the valve seat and maintained in an open configuration.

Embodiment 2. The downhole tool according to any prior embodiment, wherein the backpressure valve cartridge includes an inner surface section and an outer surface section and a hinge including a hinge pin that pivotally supports the flapper valve.

Embodiment 3. The downhole tool according to any prior embodiment, wherein the flapper valve includes a hinge portion that is receptive of the hinge pin and a valve portion including a sealing surface, the valve portion extending radially outwardly of the hinge portion.

Embodiment 4. The downhole tool according to any prior embodiment, wherein the downhole tool includes a locking mechanism that secures the backpressure valve cartridge in the second position.

Embodiment 5. The downhole tool according to any prior embodiment, wherein the locking mechanism includes a dog that is radially inwardly biased into a recess formed in the valve seat.

Embodiment 6. The downhole tool according to any prior embodiment, wherein the locking mechanism includes a body lock ring.

Embodiment 7. A resource exploration and recovery system comprising: a first system; a second system fluidically connected to the first system, the second system including at least one tubular extending into a formation, the at least one tubular supporting a downhole tool and including an outer surface and an inner surface defining a flowbore having a longitudinal axis, the downhole tool comprising: a backpressure valve cartridge arranged in the flowbore, the backpressure valve cartridge including a passage, a valve seat arranged in the passage, and a flapper valve pivotally mounted relative to the valve seat in the passage, wherein the valve seat is shiftable within the backpressure valve cartridge along the longitudinal axis to shift the flapper valve between a first position, wherein the flapper valve is free to pivot relative to the valve seat, and a second position, wherein the flapper valve is pivoted away from the valve seat and maintained in an open configuration.

Embodiment 8. The resource exploration and recovery system according to any prior embodiment, wherein the backpressure valve cartridge includes an inner surface section and an outer surface section and a hinge including a hinge pin that pivotally supports the flapper valve.

Embodiment 9. The resource exploration and recovery system according to any prior embodiment, wherein the flapper valve includes a hinge portion that is receptive of the hinge pin and a valve portion including a sealing surface.

Embodiment 10. The resource exploration and recovery system according to any prior embodiment, wherein the downhole tool includes a locking mechanism that secures the backpressure valve cartridge in the second position.

Embodiment 11. The resource exploration and recovery system according to any prior embodiment, wherein the locking mechanism includes a dog that is radially inwardly biased into a recess formed in the valve seat.

Embodiment 12. The resource exploration and recovery system according to any prior embodiment, wherein the locking mechanism includes a body lock ring.

Embodiment 13. A method of operating a backpressure valve comprising: shifting a valve seat arranged in a passage of a backpressure valve cartridge including a flapper valve along a longitudinal axis of a flowbore; and engaging the flapper valve with the valve seat causing the flapper valve to pivot about a hinge and transition from a first position, wherein the flapper valve is free to rotate about the hinge to a second position, wherein the flapper valve is pivoted away from the valve seat and maintained in an open configuration.

Embodiment 14. The method according to any prior embodiment, wherein shifting the valve seat includes applying pressure to a drop ball resting on the valve seat.

Embodiment 15. The method according to any prior embodiment, further comprising: locking the flapper valve in the second position.

Embodiment 16. The method according to any prior embodiment, wherein locking the flapper valve in the second position includes wedging the valve seat in the passage.

Embodiment 17. The method according to any prior embodiment, wherein locking the flapper valve in the second position includes engaging a body lock ring arranged in the passage.

Embodiment 18. The method according to any prior embodiment, wherein locking the flapper valve in the second position includes shifting a dog into the valve seat.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a tubular having an outer surface and an inner surface defining a flowbore having a longitudinal axis; and a backpressure valve cartridge arranged in the flowbore, the backpressure valve cartridge including a passage, a valve seat arranged in the passage, and a flapper valve pivotally mounted relative to the valve seat in the passage, wherein the valve seat is shiftable within the backpressure valve cartridge along the longitudinal axis to shift the flapper valve between a first position, wherein the flapper valve is free to pivot relative to the valve seat, and a second position, wherein the flapper valve is pivoted away from the valve seat and maintained in an open configuration.

2. The downhole tool according to claim 1, wherein the backpressure valve cartridge includes an inner surface section and an outer surface section and a hinge including a hinge pin that pivotally supports the flapper valve.

3. The downhole tool according to claim 2, wherein the flapper valve includes a hinge portion that is receptive of the hinge pin and a valve portion including a sealing surface, the valve portion extending radially outwardly of the hinge portion.

4. The downhole tool according to claim 1, wherein the downhole tool includes a locking mechanism that secures the backpressure valve cartridge in the second position.

5. The downhole tool according to claim 4, wherein the locking mechanism includes a dog that is radially inwardly biased into a recess formed in the valve seat.

6. The downhole tool according to claim 4, wherein the locking mechanism includes a body lock ring.

7. A resource exploration and recovery system comprising:

a first system;

a second system fluidically connected to the first system, the second system including at least one tubular extending into a formation, the at least one tubular supporting a downhole tool and including an outer surface and an inner surface defining a flowbore having a longitudinal axis, the downhole tool comprising:

a backpressure valve cartridge arranged in the flowbore, the backpressure valve cartridge including a passage, a valve seat arranged in the passage, and a flapper valve pivotally mounted relative to the valve seat in the passage, wherein the valve seat is shiftable within the backpressure valve cartridge along the longitudinal axis to shift the flapper valve between a first position, wherein the flapper valve is free to pivot relative to the valve seat, and a second position, wherein the flapper valve is pivoted away from the valve seat and maintained in an open configuration.

8. The resource exploration and recovery system according to claim 7, wherein the backpressure valve cartridge includes an inner surface section and an outer surface section and a hinge including a hinge pin that pivotally supports the flapper valve.

9. The resource exploration and recovery system according to claim 8, wherein the flapper valve includes a hinge portion that is receptive of the hinge pin and a valve portion including a sealing surface.

10. The resource exploration and recovery system according to claim 7, wherein the downhole tool includes a locking mechanism that secures the backpressure valve cartridge in the second position.

11. The resource exploration and recovery system according to claim 10, wherein the locking mechanism includes a dog that is radially inwardly biased into a recess formed in the valve seat.

12. The resource exploration and recovery system according to claim 11, wherein the locking mechanism includes a body lock ring.

13. A method of operating a backpressure valve comprising:

shifting a valve seat arranged in a passage of a backpressure valve cartridge including a flapper valve along a longitudinal axis of a flowbore; and engaging the flapper valve with the valve seat causing the flapper valve to pivot about a hinge and transition from a first position, wherein the flapper valve is free to rotate about the hinge to a second position, wherein the flapper valve is pivoted away from the valve seat and maintained in an open configuration.

14. The method of claim 13, wherein shifting the valve seat includes applying pressure to a drop ball resting on the valve seat.

15. The method of claim 13, further comprising: locking the flapper valve in the second position.

16. The method of claim 15, wherein locking the flapper valve in the second position includes wedging the valve seat in the passage.

17. The method of claim 15, wherein locking the flapper valve in the second position includes engaging a body lock ring arranged in the passage.

18. The method of claim 15, wherein locking the flapper valve in the second position includes shifting a dog into the valve seat.

* * * * *